US008092718B2

(12) United States Patent
Watanabe

(10) Patent No.: US 8,092,718 B2
(45) Date of Patent: Jan. 10, 2012

(54) SEMICONDUCTIVE SEAMLESS BELT

(75) Inventor: Yoshinori Watanabe, Ibaraki (JP)

(73) Assignee: Nitto Denko Corporation, Osaka (JP)

( * ) Notice: Subject to any disclaimer, the term of this patent is extended or adjusted under 35 U.S.C. 154(b) by 134 days.

(21) Appl. No.: 12/442,019

(22) PCT Filed: Sep. 21, 2006

(86) PCT No.: PCT/JP2006/318768

§ 371 (c)(1),
(2), (4) Date: Mar. 19, 2009

(87) PCT Pub. No.: WO2008/035426

PCT Pub. Date: Mar. 27, 2008

(65) Prior Publication Data

US 2010/0019206 A1 Jan. 28, 2010

(51) Int. Cl.
*H01B 1/12* (2006.01)
*G03G 15/00* (2006.01)

(52) U.S. Cl. ..... 252/500; 399/303; 399/162; 399/313; 399/396

(58) Field of Classification Search ..... 252/500; 399/303, 162, 313, 396
See application file for complete search history.

(56) References Cited

U.S. PATENT DOCUMENTS

| | | | | |
|---|---|---|---|---|
| 6,728,502 | B2 * | 4/2004 | Hara | 399/176 |
| 7,638,183 | B2 * | 12/2009 | Kim | 428/212 |
| 2002/0054971 | A1 * | 5/2002 | Shimojo et al. | 428/36.9 |
| 2003/0175045 | A1 * | 9/2003 | Hara | 399/176 |
| 2007/0009817 | A1 * | 1/2007 | Kim | 430/56 |
| 2010/0230640 | A1 * | 9/2010 | Nakagawa | 252/500 |
| 2010/0329751 | A1 * | 12/2010 | Ichino et al. | 399/313 |

FOREIGN PATENT DOCUMENTS

| | | | | |
|---|---|---|---|---|
| CN | 85101150 | A | | 1/1987 |
| CN | 1407017 | A | | 4/2003 |
| JP | 05-077252 | A | | 3/1993 |
| JP | 10-063115 | A | | 3/1998 |
| JP | 2001129837 | A | * | 5/2001 |
| JP | 2003213014 | A | | 7/2003 |
| JP | 2004-99709 | A | | 4/2004 |
| JP | 2004123774 | A | | 4/2004 |
| JP | 2004210828 | A | * | 7/2004 |
| JP | 2004284164 | A | * | 10/2004 |
| JP | 2004284166 | A | * | 10/2004 |
| JP | 2004287005 | A | | 10/2004 |
| JP | 2006-133510 | A | | 5/2006 |
| JP | 2006267572 | A | * | 10/2006 |

OTHER PUBLICATIONS

Japanese Office Action dated Jul. 21, 2010 issued in counterpart Japanese Application No. 2005-085800.
Chinese Office Action issued for Application No. 2006-80055916.5, dated Aug. 25, 2010.
Japanese Office Action issued on Nov. 16, 2010 in corresponding Japanese Patent Application No. 2005-085800.
Korean Patent Office, dated Mar. 19, 2011, issued in Application No. 10-2009-7005839.
Chinese Office Action dated Apr. 8, 2011 issued in Application No. 200680055915.6.
Korean Office Action issued on May 31, 2011 in corresponding Korean Patent Application No. 10-2009-7005839.
Communication dated Aug. 16, 2011 from the Korean Intellectual Property Office in a counterpart application No. 10-2009-7005839.

* cited by examiner

*Primary Examiner* — Douglas McGinty
(74) *Attorney, Agent, or Firm* — Sughrue Mion, PLLC

(57) ABSTRACT

The present invention provides a semiconductive seamless belt, which is obtained from a polyamide acid solution containing a tertiary amine having a boiling point of 200° C. or higher and an acid dissociation constant pKa of 4 to 9.

1 Claim, No Drawings

SEMICONDUCTIVE SEAMLESS BELT

TECHNICAL FIELD

The present invention relates to a semiconductive seamless belt which can be preferably used as a photosensitive belt, an intermediate transfer belt, and a transfer transportation belt in photorecording device such as color copying machines, laser-beam printers, or facsimile machines.

BACKGROUND ART

Hitherto, as apparatus arranged to form and record an image according to the electrophotographic method, color copying machines, laser-beam printers, video printers, facsimile machines, a multi function printer thereof, and the like have been known. In such a kind of apparatus, for the purpose of elongation of the apparatus lifetime, an intermediate transfer method in which an image formed on an image carrier such as a photosensitive drum with a recording material such as toner is transferred onto a printing sheet or the like method has been investigated. Moreover, for the purpose of miniaturization of the apparatus, a method using a transfer transportation belt in which a transfer belt also plays a role of conveying a printing sheet has been also investigated.

As a belt for use as the intermediate transfer belt, the transfer transportation belt, and the like, there has been proposed an intermediate transfer belt in which a conductive filler is dispersed in a polyimide resin excellent in mechanical properties and thermal resistance (see, e.g., Patent Documents 1 and 2).

Patent Document 1: JP-A-5-77252

Patent Document 2: JP-A-10-63115

DISCLOSURE OF THE INVENTION

Problems that the Invention is to Solve

However, although a semiconductive belt including a polyimide resin hitherto proposed is used as an intermediate transfer belt or the like in color laser printers, durability thereof is not sufficient. This is because flexure resistance of the belt is lowered by the presence of a large amount of filler in the polyimide resin. For the reason, in the case where the belt is used as an intermediate transfer belt, there arises a problem that a crack is apt to occur starting from the edge part of the belt during driving. In order to solve the problem of cracking at the edge part of the belt, a method of attaching a pressure-sensitive adhesive tape to the edge part of the belt for the purpose of reinforcement is employed. However, this method causes decrease in productivity of the belt and increase in costs.

Thus, an object of the invention is to provide a semiconductive seamless belt excellent in flexure resistance and hardly causing a crack starting from the edge part of the belt during driving in the case where the belt is used as an intermediate transfer belt or the like in photorecording device.

Means for Solving the Problems

As a result of the extensive studies, the present inventors have found that the above object can be achieved by the semiconductive seamless belt shown below and thus have accomplished the invention.

The semiconductive seamless belt of the invention is obtained by the use of a polyamide acid solution containing a tertiary amine having a boiling point of 200° C. or higher and an acid dissociation constant pKa of 4 to 9 ($4 \leqq pKa \leqq 9$).

It has been found that a tertiary amine is a great factor of determining characteristics of a polyamide in a semiconductive seamless belt, particularly a polyimide belt and particularly, in the invention, its boiling point and acid dissociation constant exert a large influence on the flexure resistance of the belt. Specifically, it has been found that when a tertiary amine having a low boiling point is used, it is difficult to form a stable polyimide belt since the tertiary amine is vaporized together with a solvent at the removal of the solvent and also when a tertiary amine having a small pKa is used, an effect of improving the flexure resistance is small. Therefore, by the use of the polyamide acid solution containing a tertiary amine which satisfies the above requirements, it becomes possible to provide a semiconductive seamless belt excellent in flexure resistance. In this connection, a method for evaluating the flexure resistance will be mentioned below.

In the invention, as the above-mentioned polyamide acid solution, it is preferred to use a polyamide acid solution containing: a copolymer including a repetition of a component A in which a fully aromatic skeleton which is a tetracarboxylic acid residue and a p-phenylene skeleton which is a diamine residue are bound by an imide bond and a component B in which a fully aromatic skeleton which is a tetracarboxylic acid residue and a diphenyl ether skeleton which is a diamine residue are bound by an imide bond; and/or a blend of a polymer including the component A as a repeating unit and a polymer including the component B as a repeating unit.

Namely, in the invention, it has been found that, in the production of the seamless belt, the polyamide acid solution is preferably a polyamide acid solution containing a copolymer of a component forming a rigid skeleton and a component forming a flexible skeleton or a blend of respective polymers of the components in order to improve the flexure resistance of the belt. Specifically, as the component forming a rigid skeleton, the component A in which a fully aromatic skeleton which is a tetracarboxylic acid residue and a p-phenylene skeleton which is a diamine residue are bound by an imide bond may be mentioned. Moreover, as the component forming a flexible skeleton, the component B in which a fully aromatic skeleton which is a tetracarboxylic acid residue and a diphenyl ether skeleton which is a diamine residue are bound by an imide bond may be mentioned. A polyimide resin can be obtained by using such a polyamide acid solution. In the production of a polyimide seamless belt, it becomes possible to provide a semiconductive seamless belt more excellent in flexure resistance by the use of a polyamide acid solution containing a copolymer including repetition of these components and/or a blend including a mixture of a polymer having the component A as a repeating unit and a polymer having the component B as a repeating unit.

In the invention, as the polyamide acid solution, it is preferred to use a polyamide acid solution composed of 5 to 95% by weight of a constitutional unit of the component A and 95 to 5% by weight of a constitutional unit of the component B.

Namely, in the invention, it has been found that, in the production of a seamless belt, it is preferable that the polyamide acid solution is used and the polyamide acid solution is composed of a component forming a rigid skeleton and a component forming a flexible skeleton in a predetermined ratio in order to improve the flexure resistance of the belt. Specifically, it becomes possible to provide a semiconductive seamless belt more excellent in flexure resistance by producing a polyimide seamless belt using a polyamide acid solution containing a constitutional unit of the component A as the component forming a rigid skeleton and a constitutional unit of the component B as the component forming a flexible skeleton in the above-mentioned ratio.

Advantage of the Invention

As above, according to the invention, it is possible to form a semiconductive seamless belt excellent in flexure resistance and hardly causing a crack starting from the edge part of the belt during driving. Therefore, an intermediate transfer belt or the like having a predetermined surface resistance value and excellent in flexure resistance even in photorecording device can be provided.

BEST MODE FOR CARRYING OUT THE INVENTION

The following will explain modes for carrying out the invention.

The invention relates to a semiconductive seamless belt to be used as an intermediate transfer belt or the like, which is constituted as follows.

The semiconductive seamless belt of the invention includes a polyimide resin obtained from the above-mentioned polyamide acid solution and may contain a conductive filler. With regard to the electric resistance value of the semiconductive belt of the invention, in the case where it is used as an intermediate transfer belt in photorecording device, a surface resistivity is preferably $10^8$ to $10^{14}\Omega/$, more preferably $10^{10}$ to $10^{13}\Omega/$.

As the conductive filler, inorganic compounds such as carbon black, aluminum, nickel, tin oxide, and potassium titanate and electrically conductive polymers including polyaniline and polyacetylene as representatives can be used. Particularly, in view of resistance control and resistance decrease, it is important to homogeneously disperse various conductive materials in the belt. Therefore, in the case where carbon black or the like is used, it is necessary to select carbon black exhibiting an excellent dispersibility and to suitably select a dispersing method. Moreover, in the case where a conductive polymer or the like is used, it is desirable to dissolve it in the same solvent as the one in which the resin materials are dissolved. The content of these various conductive materials can be suitably selected depending on the kind of the conductive materials but is preferably about 5 to 50% by weight, more preferably 7 to 40% by weight based on the amount of the resin constituting the belt. When the content is less than 5% by weight, homogeneity of the electric resistance decreases and decrease in surface resistivity during endurance use becomes remarkable in some cases. On the other hand, when the content thereof exceeds 50% by weight, a desired resistance value is hardly obtained and a molded article becomes brittle, so that the case is not preferred.

Carbon black that is a representative conductive filler can impart conductivity even when mixing amount thereof is small, but the mixing amount thereof for obtaining a predetermined resistance value is preferably about 20 to 30 parts by weight based on 100 parts by weight of the polyimide resin. When the mixing amount of carbon black is more than the range, flexure resistance decreases. When the amount is less than the range, change in resistance value depending on the mixing amount of carbon black becomes large, so that it becomes very difficult to obtain a predetermined resistance value.

Moreover, as mentioned above, in the polyimide belt, it has been revealed that the boiling point and acid dissociation constant of the tertiary amine in the polyamide acid solution exert a large influence on the flexure resistance of the belt. Specifically, by the use of a tertiary amine having a boiling point of 200° C. or higher and an acid dissociation constant pKa of 4 or more and 9 or less, a polyimide belt excellent in flexure resistance is obtained and thus the case is preferable. In this case, with regard to the boiling point of the tertiary amine, when a tertiary amine having a low boiling point is used, since the tertiary amine has been vaporized together with a solvent at the removal of the solvent and hence the tertiary amine does not stably remain on a film, a desired effect is not obtained in the next imidation step in many cases. Moreover, with regard to the acid dissociation constant, in a tertiary amine, the larger the value is, the stronger the basicity is and generally the higher the reactivity is. However, when an amine having a large pKa is used, although the reactivity becomes high, flexure resistance is not improved in many cases. Furthermore, as a harmful influence of the high reactivity, storage stability at ordinary temperature decreases at the time when the amine is mixed with a polyamide acid solution. On the other hand, when an amine having a small pKa is used, since the reactivity becomes low, the influence on flexure resistance is small. As specific tertiary amines, isoquinoline, imidazole, 2-ethyl-4-methylimidazole, 2-phenylimidazole, N-methylimidazole, and the like are used.

At the preparation of the polyimide resin, there may be suitably used a polyamide acid solution containing a copolymer including a repetition of: a component A in which a fully aromatic skeleton which is a tetracarboxylic acid residue and a p-phenylene skeleton which is a diamine residue are bound by a imide bond, and a component B in which a fully aromatic skeleton which is a tetracarboxylic acid residue and a diphenyl ether skeleton which is a diamine residue are bound by a imide bond; and/or a blend of: a polymer including the component A as a repeating unit, and a polymer including the component B as a repeating unit.

For the preparation of the fully aromatic skeleton, a tetracarboxylic dianhydride is employed and examples thereof include pyromellitic dianhydride (PMDA), 3,3',4,4'-biphenyltetracarboxylic dianhydride (BPDA), 2,3,6,7-naphthalenetetracarboxylic dianhydride, 1,2,5,6-naphthalenetetracarboxylic dianhydride, and 1,4,5,8-naphthalenetetracarboxylic dianhydride. Of these, particularly, 3,3',4,4'-biphenyltetracarboxylic dianhydride (BPDA) is preferred. Moreover, for the preparation of the p-phenylene skeleton, p-phenylenediamine can be used. For the preparation of the diphenyl ether skeleton, 4,4'-diaminodiphenyl ether, 3,3'-diaminodiphenyl ether, and the like are used and particularly, 4,4'-diaminodiphenyl ether is preferred.

In order to improve the flexure resistance of the polyimide seamless belt by controlling the composition of the polyamide acid solution, it is preferred to use a polyamide acid solution containing a copolymer of a component forming a rigid skeleton and a component forming a flexible skeleton and/or a blend of respective polymers of the components. Moreover, as the constitutional units of these components, the constitutional unit of the component A preferably accounts for 5 to 95% by weight and more preferably 30 to 70% by weight. The constitutional unit of the component B preferably accounts for 95 to 5% by weight and more preferably 70 to 30% by weight. In the case of the belt exclusively composed of the component A having a rigid skeleton, the belt exhibits a high elasticity but is low in flexure resistance owing to a low flexibility. On the other hand, in the case of the belt exclusively composed of the component B having a flexible skeleton, the belt exhibits a high flexibility and a large tensile elongation but the flexure resistance is low as compared with the copolymer of the component A and the component B and the blend of the polymer of the component A and the polymer of the component B. With regard to the evaluation method of the flexure resistance, the belt is evaluated as mentioned below by the MIT test defined by JIS-P8115 with the number of times for flexure resistance until it is broken.

With regard to the method for producing the seamless belt of the invention, a method of obtaining the seamless belt by homogeneously applying the polyamide acid solution to the inner surface of a cylindrical mold, then removing the solvent at a low temperature, and heating the remaining one to a high temperature where a ring-closure imidation occurs is preferred.

Moreover, as a method for preparing a carbon black-dispersed polyamide acid resin, which is a raw material of the semiconductive belt, by dispersing carbon black in the polyamide acid solution of the invention, the following may be mentioned, for example. First, carbon black is dispersed in an organic polar solvent to prepare a carbon black dispersion. As the organic polar solvent, N-methyl-2-pyrrolidone, N,N-dimethylformamide, N,N-dimethylacetamide, and the like may be used. As a method for homogeneously dispersing carbon black in the solvent, methods using a planetary mixer or a beads mil, ultrasonic waves, or the like may be mentioned. At that time, in order to enhance affinity of carbon black to the solvent, a dispersant such as poly(N-vinyl-pyrrolidone) or poly(N,N'-diethylacrylamide) may be used. The tertiary amine may be added to the carbon black dispersion or may be finally added to the carbon black-dispersed polyamide acid solution, and the addition of the tertiary amine can be performed by any suitable method.

A tetracarboxylic dianhydride or its derivative (a) and a diamine (b) are dissolved in the carbon black dispersion thus obtained and are polymerized to prepare the carbon black-dispersed polyamide acid solution. On this occasion, the monomer concentration (concentration of (a) and (b) in a solvent) is determined depending on various conditions but is preferably 5 to 30% by weight. Moreover, the reaction temperature is preferably determined as a temperature of 80° C. or lower and particularly, a temperature of 5 to 50° C. is preferred.

The viscosity of the amide acid solution obtained by the above-mentioned reaction increases but, when heating and stirring are continued, the viscosity of the polyamide acid solution decreases. Utilizing this phenomenon, the amide acid solution can be adjusted to have a predetermined viscosity. The heating temperature on this occasion is preferably 50 to 90° C.

As a method for producing the seamless belt of the invention, the following method may be mentioned, for example. The carbon black-dispersed polyamide acid solution obtained in the above-mentioned reaction is fed into a cylindrical mold and homogeneously developed onto the inner peripheral surface of the mold with centrifugal force by a rotational centrifugal molding method. On this occasion, the viscosity of the solution is preferably 1 to 1000 Pa·s (25° C.) as measured by a B-type viscometer. In the case where the viscosity is out of the range, homogeneous development is difficult at the centrifugal molding and uneven thickness of the belt is caused. After the film formation, the developed layer is heated at 80 to 150° C. to remove the solvent. Then, the ring-closure imidation reaction is allowed to proceed by heating the developed layer at a high temperature of 300 to 450° C. and thereafter, the obtained belt is taken out of the mold. The heating at the solvent removal and the imidation reaction should be uniformly performed. When the heating is not uniform, aggregation and unevenness of carbon black occur even at the solvent vaporization to result in variation in resistance value of the belt. As a method for uniform heating, there may be mentioned methods such as a method of heating under rotation of the mold and a method of improvement in circulation of hot air, and methods such as a method of charging at a low temperature and elevating temperature at a low rate.

EXAMPLES

The following will explain the present invention further in detail with reference to specific Examples. Moreover, an evaluation item in Examples was measured as follows. In this connection, the invention is not limited to such Examples and evaluation method.

Evaluation Method

Flexure Resistance

A test piece having a width of 15 mm was cut out from a resulting belt and evaluation of flexure resistance was performed in accordance with JIS-P8115 by means of an MIT testing machine (manufactured by Tester Sangyo Co., Ltd.). The number of bending times until the test piece was broken after the start of the test was regarded as the number of times for flexure resistance.

Example 1

In a ball mill, 78.7 g of Dried carbon black (MA-100 manufactured by Mitsubishi Chemical Corporation) was mixed into 1889.3 g of N-methyl-2-pyrrolidone at room temperature for 12 hours. After 6.80 g of imidazole was charged to the solution, 294.0 g of 3,3',4,4'-biphenyltetracarboxylic dianhydride (BPDA), 75.6 g of p-phenylenediamine (PDA), and 60.0 g of 4,4'-diaminodiphenyl ether (DDE) were charged thereto at room temperature under nitrogen atmosphere (component A/component B=70/30). After thickened by a polymerization reaction, the solution was stirred at 70° C. for 15 hours and then a carbon black-dispersed polyamide acid solution of 120 Pa·s was obtained. The solution was applied onto the inner surface of a drum-shape mold having an inner diameter of 180 mm and a length of 500 mm by means of a dispenser so as to provide a final thickness of 75 μm and then, the drum-shape mold was rotated at 1500 rpm for 10 minutes to obtain a homogeneous developed layer. Then, the layer was heated for 30 minutes in a drying oven at 120° C. where hot air was uniformly circulated while the drum-shape mold was rotated at 250 rpm, thereby the solvent being removed. Furthermore, the temperature was raised to 360° C. at a rate of 2° C./min and heating was continued for 10 minutes to allow imidation to proceed. After the whole was cooled to room temperature, the layer was removed from the inner surface of the mold to obtain a semiconductive polyimide belt having a thickness of 75 μm.

Example 2

In a ball mill, 82.4 g of Dried carbon black (MA-100 manufactured by Mitsubishi Chemical Corporation) was mixed into 1997.6 g of N-methyl-2-pyrrolidone at room temperature for 12 hours. After 6.80 g of imidazole was charged to the solution, 294.0 g of 3,3',4,4'-biphenyltetracarboxylic dianhydride (BPDA), 54.0 g of p-phenylenediamine (PDA), and 100.0 g of 4,4'-diaminodiphenyl ether (DDE) were charged thereto at room temperature under nitrogen atmosphere (component A/component B=50/50). After thickened by a polymerization reaction, the solution was stirred at 70° C. for 15 hours and then a carbon black-dispersed polyamide acid solution of 120 Pa·s was obtained. The subsequent operations were performed in the same manner as in Example 1 to obtain a semiconductive polyimide belt having a thickness of 75 μm.

Example 3

In a ball mill, 86.1 g of Dried carbon black (MA-100 manufactured by Mitsubishi Chemical Corporation) was mixed into 2065.9 g of N-methyl-2-pyrrolidone at room temperature for 12 hours. After 6.80 g of imidazole was charged to the solution, 294.0 g of 3,3',4,4'-biphenyltetracarboxylic dianhydride (BPDA), 32.4 g of p-phenylenediamine (PDA), and 140.0 g of 4,4'-diaminodiphenyl ether (DDE) were charged thereto at 40° C. under nitrogen atmosphere (component A/component B=30/70). After thickened by a polymerization reaction, the solution was stirred at 70° C. for 15 hours and then a carbon black-dispersed polyamide acid solution of 120 Pa·s was obtained. The subsequent operations were performed in the same manner as in Example 1 to obtain a semiconductive polyimide belt having a thickness of 75 μm.

Comparative Example 1

In a ball mill 73.2 g of Dried carbon black (MA-100 manufactured by Mitsubishi Chemical Corporation) was mixed into 1756.3 g of N-methyl-2-pyrrolidone at room temperature for 12 hours. After 6.80 g of imidazole was charged to the solution, 294.0 g of 3,3',4,4'-biphenyltetracarboxylic dianhydride (BPDA) and 108.0 g of p-phenylenediamine (PDA) were charged thereto at room temperature under nitrogen atmosphere (component A/component B=100/0). After thickened by a polymerization reaction, the solution was stirred at 70° C. for 15 hours and then a carbon black-dispersed polyamide acid solution of 120 Pa·s was obtained. The following operations were performed in the same manner as in Example 1 to obtain a semiconductive polyimide belt having a thickness of 75 μm.

Comparative Example 2

In a ball mill, 91.6 g of Dried carbon black (MA-100 manufactured by Mitsubishi Chemical Corporation) was mixed into 2198.4 g of N-methyl-2-pyrrolidone at room temperature for 12 hours. After 6.80 g of imidazole was charged to the solution, 294.0 g of 3,3',4,4'-biphenyltetracarboxylic dianhydride (BPDA) and 200.0 g of 4,4'-diaminodiphenyl ether (DDE) were charged thereto at room temperature under nitrogen atmosphere (component A/component B=0/100). After thickened by a polymerization reaction, the solution was stirred at 70° C. for 15 hours and then a carbon black-dispersed polyamide acid solution of 120 Pa·s was obtained. The subsequent operations were performed in the same manner as in Example 1 to obtain a semiconductive polyimide belt having a thickness of 75 μm.

Comparative Example 3

In a ball mill, 82.4 g of Dried carbon black (MA-100 manufactured by Mitsubishi Chemical Corporation) was mixed into 1997.6 g of N-methyl-2-pyrrolidone at room temperature for 12 hours. After 8.50 g of pyridine was charged to the solution, 294.0 g of 3,3',4,4'-biphenyltetracarboxylic dianhydride (BPDA), 54.0 g of p-phenylenediamine (PDA), and 100.0 g of 4,4'-diaminodiphenyl ether (DDE) were charged thereto at room temperature under nitrogen atmosphere (component A/component B=50/50). After thickened by a polymerization reaction, the solution was stirred at 70° C. for 15 hours and then a carbon black-dispersed polyamide acid solution of 120 Pa·s was obtained. The following operations were performed in the same manner as in Example 1 to obtain a semiconductive polyimide belt having a thickness of 75 μm.

Evaluation Results

The results of the evaluation of the above samples were as shown in Table 1.

TABLE 1

| | | Unit | Example 1 | Example 2 | Example 3 | Comparative Example 1 | Comparative Example 2 | Comparative Example 3 |
|---|---|---|---|---|---|---|---|---|
| Tertiary amine | Boiling point | ° C. | 250 | 250 | 250 | 250 | 250 | 115 |
| | pKa | — | 6.9 | 6.9 | 6.9 | 6.9 | 6.9 | 5.3 |
| component A/component B | | %/% | 70/30 | 50/50 | 30/70 | 100/0 | 0/100 | 50/50 |
| Flexure resistance | | times | 55,000 | 43,000 | 25,000 | 12,000 | 10,000 | 10,000 |

While the invention has been described in detail and with reference to specific embodiments thereof, it will be apparent to one skilled in the art that various changes and modifications can be made therein without departing from the spirit and scope thereof.

The present application is based on Japanese Patent Application No. 2005-085800 filed on Mar. 24, 2005, and the contents are incorporated herein by reference.

INDUSTRIAL APPLICABILITY

The semiconductive seamless belt of the present invention can be preferably used as a photosensitive belt, an intermediate transfer belt, a transfer transportation belt, and the like in photorecording device such as color copying machines, laser-beam printers, or facsimile machines.

The invention claimed is:

1. A semiconductive seamless belt comprising a polyimide, which is obtained from a polyamide acid solution containing a tertiary amine having a boiling point of 200° C. or higher and an acid dissociation constant pKa of 4 to 9, wherein the polyamide acid solution comprises at least one of:

a copolymer comprising a repetition of a component A in which a fully aromatic skeleton which is a tetracarboxylic acid residue and a p-phenylene skeleton which is a diamine residue are bound by an imide bond, and a component B in which a fully aromatic skeleton which is a tetracarboxylic acid residue and a diphenyl ether skeleton which is a diamine residue are bound by an imide bond; or a blend of: a polymer comprising the component A as a repeating unit, and a polymer comprising the component B as a repeating unit, and wherein the ratio of component A to component B is 70/30 to 30/70.

* * * * *